US008683925B2

(12) United States Patent
Liggett

(10) Patent No.: US 8,683,925 B2
(45) Date of Patent: Apr. 1, 2014

(54) ZIP LINE TRANSPORT TROLLEY SYSTEM

(76) Inventor: James Liggett, Martin, MI (US)

( * ) Notice: Subject to any disclaimer, the term of this patent is extended or adjusted under 35 U.S.C. 154(b) by 559 days.

(21) Appl. No.: 12/750,970

(22) Filed: Mar. 31, 2010

(65) Prior Publication Data

US 2011/0239895 A1 Oct. 6, 2011

(51) Int. Cl.
*A63G 21/22* (2006.01)
*B61B 7/00* (2006.01)

(52) U.S. Cl.
USPC ..... 104/113; 104/115; 104/117

(58) Field of Classification Search
USPC ..... 104/112, 113, 115, 117, 89; 182/36
See application file for complete search history.

(56) References Cited

U.S. PATENT DOCUMENTS

| | | | | | |
|---|---|---|---|---|---|
| 249,425 | A * | 11/1881 | Walling | ..... | 104/113 |
| 399,283 | A * | 3/1889 | Prittie | ..... | 104/113 |
| 1,019,984 | A * | 3/1912 | McGee | ..... | 212/75 |
| 3,040,678 | A * | 6/1962 | McEwen | ..... | 105/150 |
| 4,062,293 | A * | 12/1977 | Davis | ..... | 104/113 |
| 5,660,113 | A * | 8/1997 | Lehotsky | ..... | 104/113 |
| 6,622,634 | B2 * | 9/2003 | Cylvick | ..... | 104/53 |

* cited by examiner

*Primary Examiner* — Mark Le
(74) *Attorney, Agent, or Firm* — Robert J. Sayfie

(57) ABSTRACT

A trolley having a trolley upper portion; a trolley wheel carriage secured to the trolley upper portion; and a trolley lower portion extending downwardly from said trolley upper portion, allowing the trolley to be displaced along a box to box cable.

2 Claims, 9 Drawing Sheets

ZIP LINE TRANSPORT TROLLEY SYSTEM

GOVERNMENT RIGHTS

This invention was not made with Government support under. The Government does not have any rights in this invention.

BACKGROUND OF THE INVENTION

What is needed is a device to reduce compression forces on zipline apparatus.

SUMMARY OF THE INVENTION

An aspect of the present invention comprises a zipline transfer device (10), comprising: a tower (200); a device to device cable (110) extending from a first tower (200) to a second tower (200); and a trolley (100) having a trolley wheel carriage (790) secured to said trolley (100).

Another aspect is a zip line transfer device (10), comprising: a tower (200) a device to counterweight cable (270) extending from a counterweight (430) to an inline transfer device (460); and a device to device cable (110) connected at one end to said inline transfer device (460), and at another end to at least one of either another tower (200) or another inline transfer device (460); an adjustable height termination means (500) movably disposed on said tower (200), said device to counterweight cable (270) extending from a counterweight (430) upwardly to said inline transfer device (460) via said adjustable height termination means (500); a moveable member (100) that is capable of being displaced on said device to device cable (110); a non tensioned cable (220) connected to said inline transfer device (460), said non tensioned cable (220) extending from said inline transfer device (460) to at least one of either a landing ramp exit device (650) or a safety cable transfer device (630), said landing ramp exit device (650) and said safety cable transfer device (630) secured to said tower (200); an ascencion-descencion means (750), whereby a person may be able to ascend or descend the tower (200) so that the person may removably be connected to a moveable member (100) at ground level before ascension, and the person may then traverse said device to device cable (110) and said non tensioned cable (220); and at least one of either said device to device cable (110), said non tensioned cable (220) and said device to counterweight cable (270) is a dual cable.

Another aspect of the invention is a trolley (100), comprising: a trolley upper portion (770); a trolley wheel carriage (790) secured to said trolley upper portion (770); and a trolley lower portion (780) extending downwardly from said trolley upper portion (770), whereby said trolley (100) can be displaced along a device to device cable (110).

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for illustrating the general principles of the invention, since the scope of the invention is best defined by the appended claims.

Figure 1:
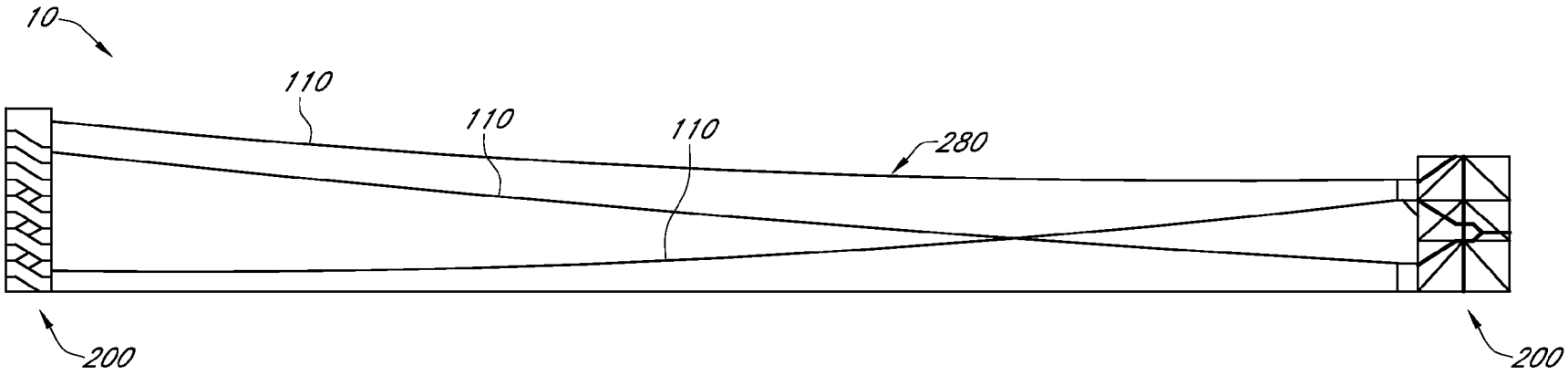
FIG. 1 is a pictorial view of one embodiment of the present invention 10 showing towers 200 and device to device cables 110.

FIG. 1 illustrates an embodiment of a zip line transport device 10, also referred to herein as a transport device 10, or the present invention 10. In one embodiment, the transport device has a tower 200 and a second tower 200. As seen in FIG. 1, a plurality of device to device cables 110 may be disposed between the first tower 200 and the second tower 200. The device to device cable 110 may form a zip line profile 280. In addition, a plurality of device to device cables 110 may form a zip line profile 280. In one embodiment, there may be two device to device cables 110 disposed next to each other to form a double zip line cables, also referred to as a double device to device cable 110, as best seen in FIG. 2.

Figure 2:
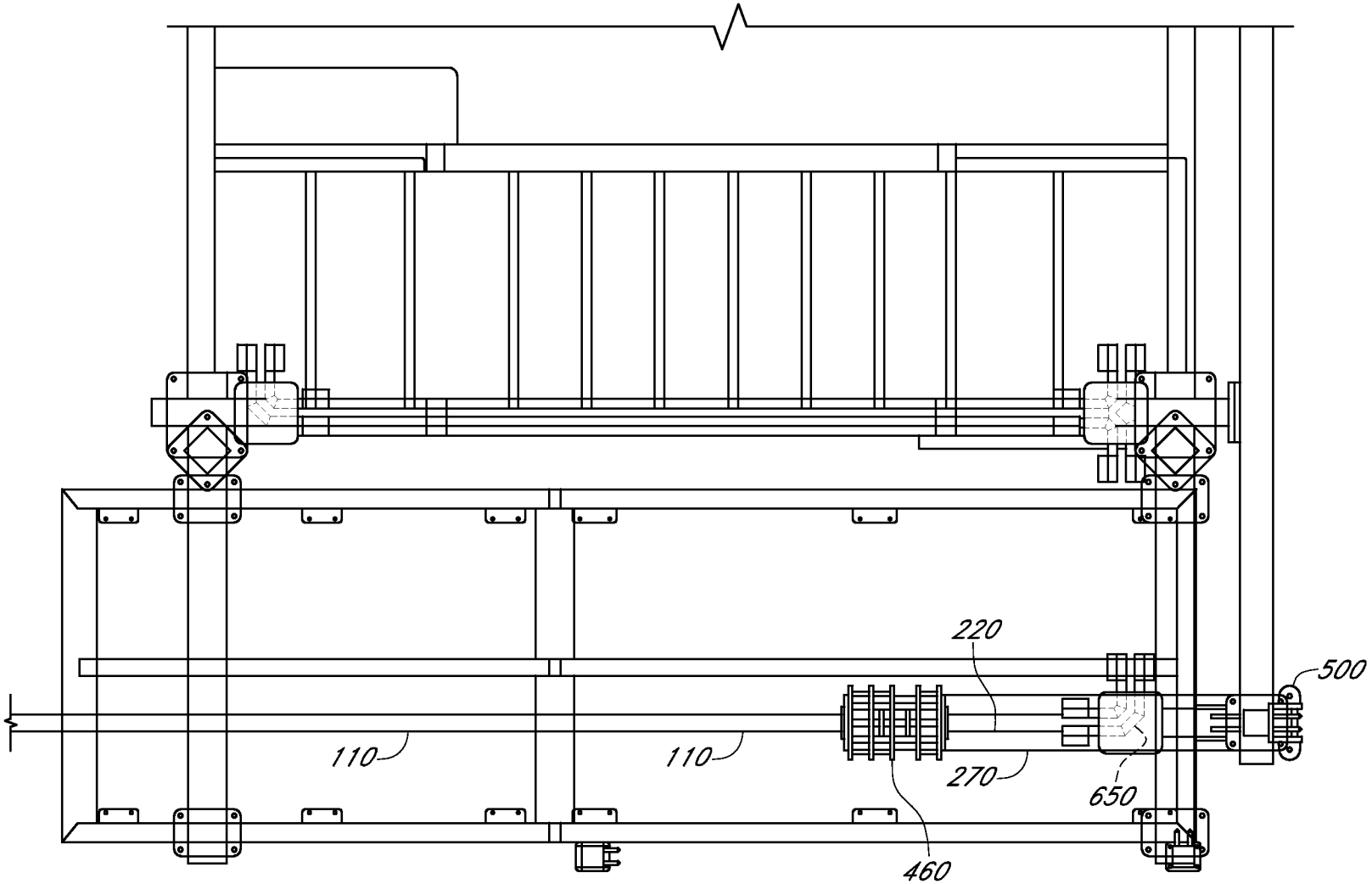
FIG. 2 is a pictorial top view of an embodiment of a portion of the tower 200 and the inline transfer device 460.
Figure 3:
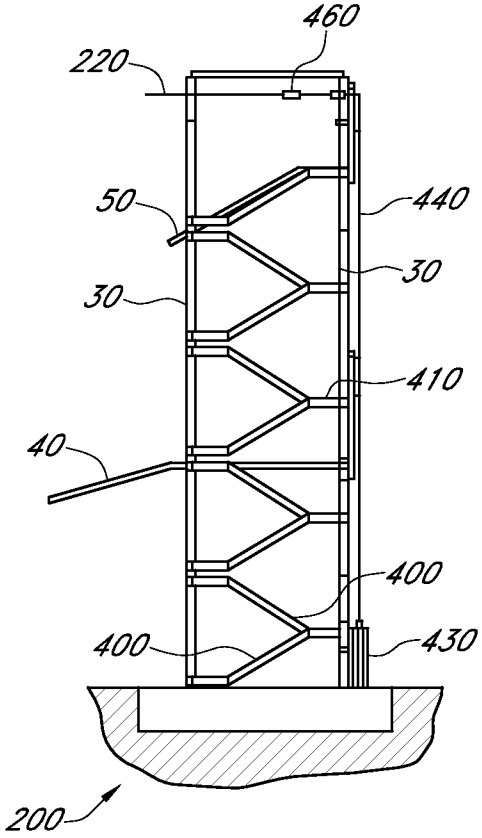
FIG. 3 is a pictorial of an embodiment of the tower 200 and counterweight 430.

As illustrated in FIG. 2, which is a top view of an embodiment of the present invention 10, a device to device cable 110 may be disposed between two inline transfer devices 460. Adevice to counterweight cable 270 may be connected at one end to the inline transfer device 460, and at another end to a counterweight 430, as illustrated in FIG. 3. In one embodiment, there may be two device to counterweight cables 270. A non-tensioned cable 220 may be disposed between the inline transfer device 460 and a landing ramp exit device 650. This configuration may allow the counterweight 430 to become displaced in a substantially vertical direction when a person or people are causing a load on the device to device cable 110. This also may reduce the tension within the device to device cable 110 and whatever the device to device cable 110 may be attached to, as compared with the device to device cable 110 secured to a fixed post, rather than a counterweight 430. FIG. 2 also illustrates a landing ramp exit device 650, which extends away from the termination beam 640.

Figure 8:
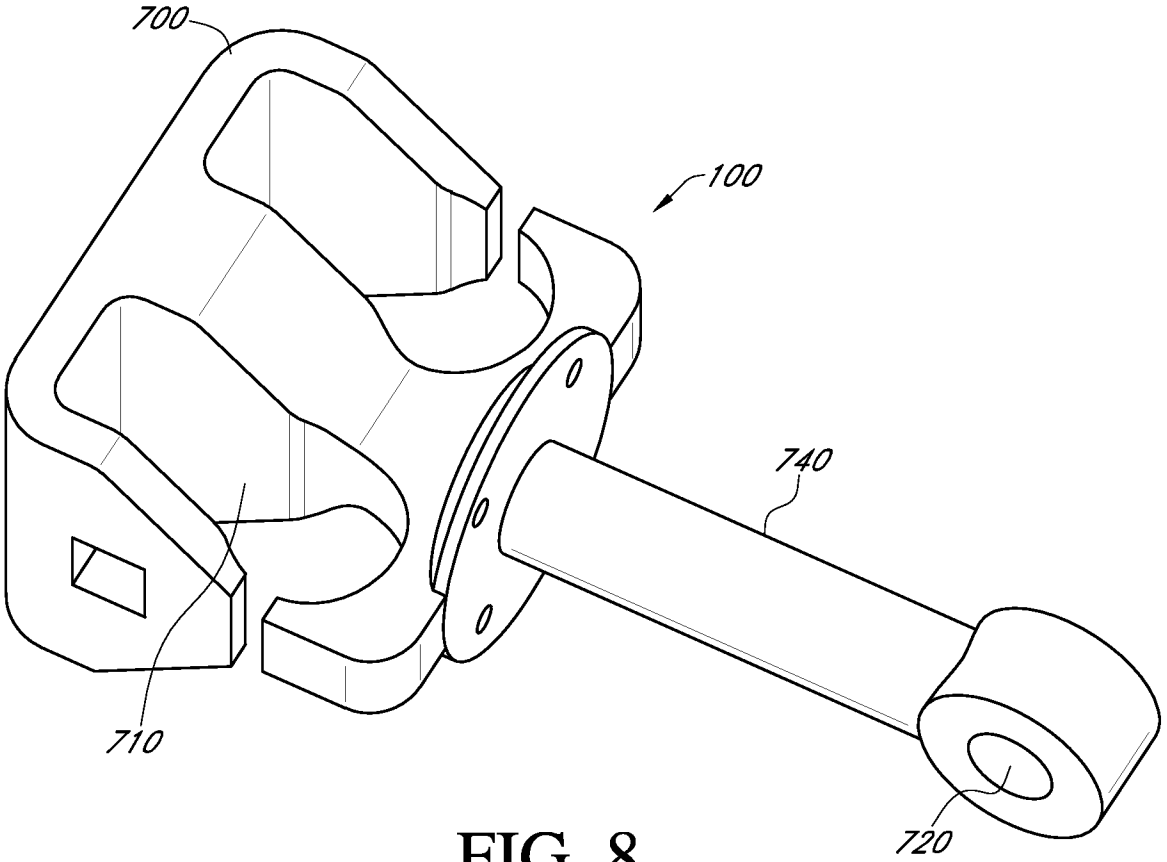
FIG. 8 is a pictorial of an embodiment of the trolley 100 or moveable member 100.
Figure 9:
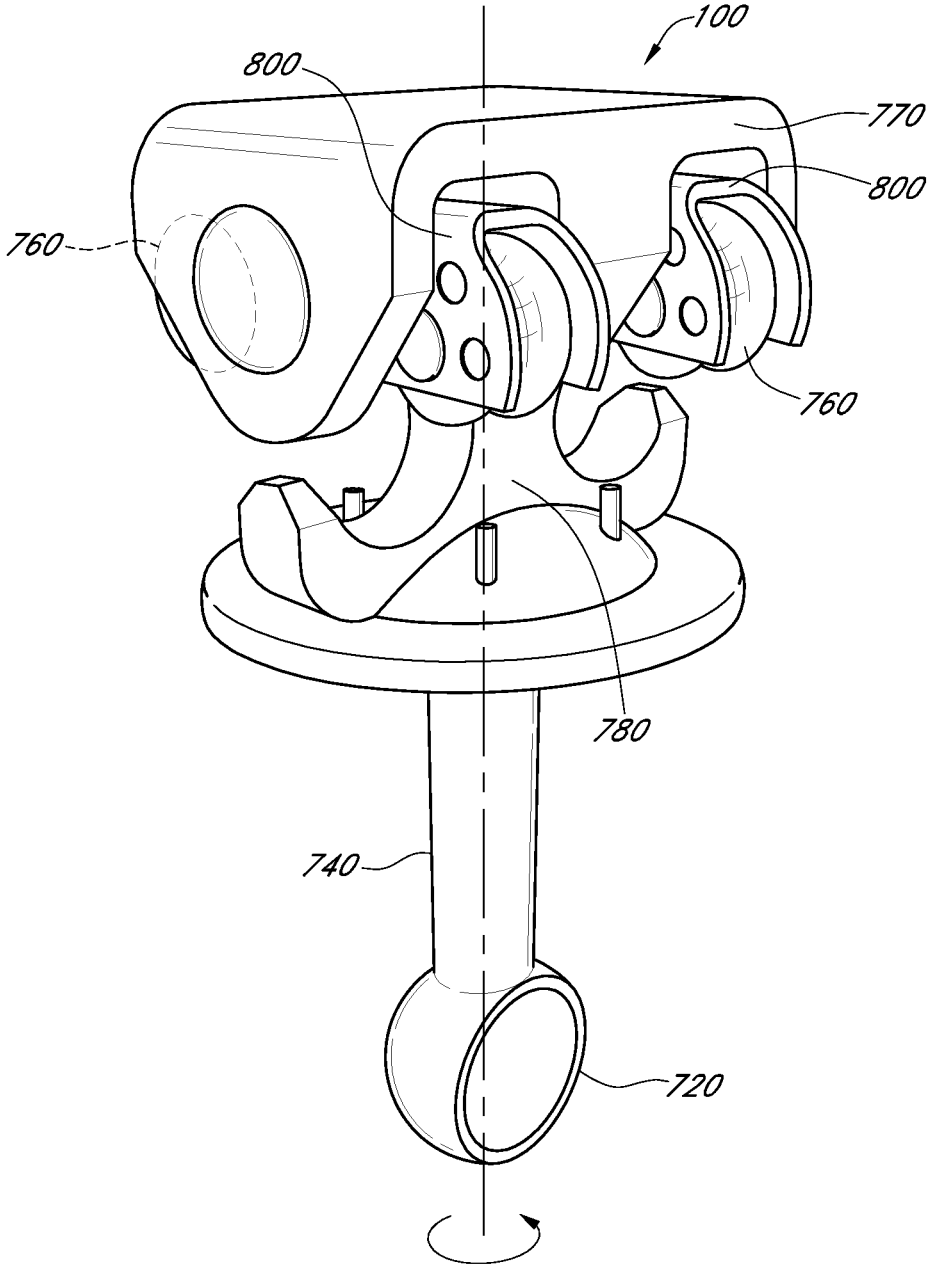
FIG. 9 is a pictorial of another embodiment of a moveable member 100 or trolley 100 of the present invention.

A person may traverse the device to device cable 110 by using a moveable member 100, also referred to herein as a trolley 100, as seen in FIGS. 8 and 9.

Figure 4:
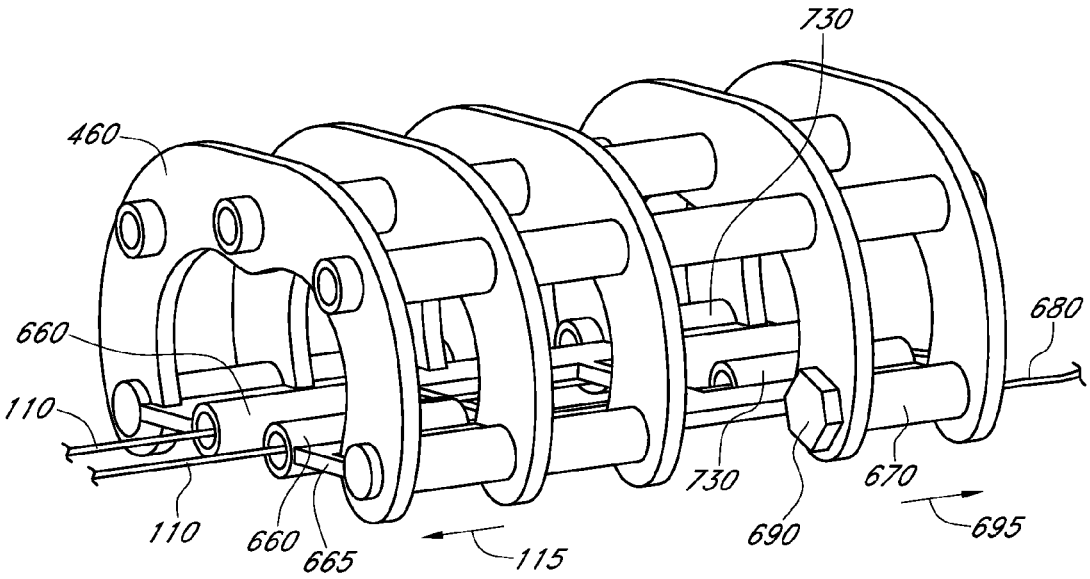
FIG. 4 is a pictorial of an embodiment of an inline transfer device 460.

FIG. 4 illustrates an inline transfer device 460. The inline transfer device 460 may have a zip line cable receiver 660. A moveable member 100 may be able to be moved past the zip line cable receiver 660 because the moveable member 100 (as seen in FIGS. 8 and 9) cable receiving aperture 710 may have a diameter or area that is larger than the diameter or area of the zip line cable receiver 660. The inline transfer device 460 may also have a counterweight cable receiver 670 secured thereto and capable of receiving a device to counterweight cable 270 therein. The device to counterweight cable 270 may have a body 690 attached thereto so that the device to counterweight cable 270, when in tension, may force the inline transfer device 460 in a first direction 695, as illustrated in FIG. 4. The device to device cable 110 may, when in tension, force the inline transfer device 460 in a direction opposite the first direction 695, which is called a second direction 115. Thus, if a person is displacing the device to device cable 110, the inline transfer device 460 may shift in the second direction 115. This may then cause the counterweight 430 to ascend upwardly, which may then reduce tension in the device to device cable 110. The counterweight 430 may be heavy enough to limit the amount of ascension, and thus tension reduction in the device to device cable 110.

FIG. 4 also illustrates the non-tensioned cable receiver 730. The non-tensioned cable 220 may be secured thereto. The non-tensioned cable receiver 730 may route users off of the apparatus 10 back to the ground as seen in FIG. 2. In one embodiment, the non tensioned cable 220 may be routed to a landing ramp exit device 650, or to a safety cable transfer device 630.

Therefore, the user may use the moveable member 100 to traverse along the device to device cable 110, after the user has left the take off ramp 50 and before the user is on the landing ramp 40. The user may also use the moveable member 100 to traverse along the non tensioned cable 220 when walking on the stairwell 750. The user may be hooked into the non tensioned cable 220 when on the ground when first being hooked into the system 10, up to being on the device to device cable 110.

The user is typically never traversing the device to device to counterweight cable 270.

The adjustable height termination assembly 500 may be able to be adjusted vertically by a fastener means, such as screws, or pins.

Figure 5:
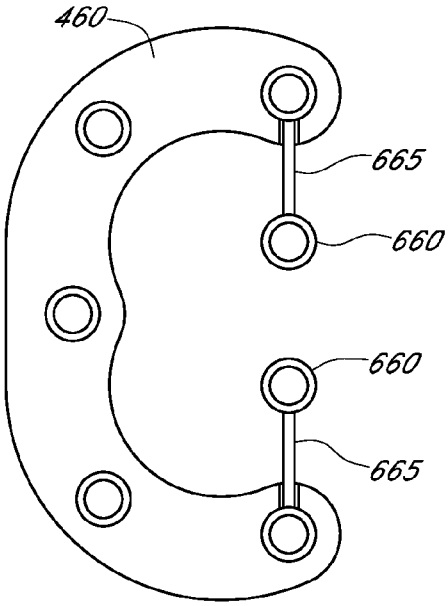
FIG. 5 is a pictorial a side view of the inline transfer device 460.

FIG. 5 illustrates at side view of the inline transfer device 460, and how a user may traverse from the device to device cable 110 to a landing ramp exit device 650.

Figure 6:
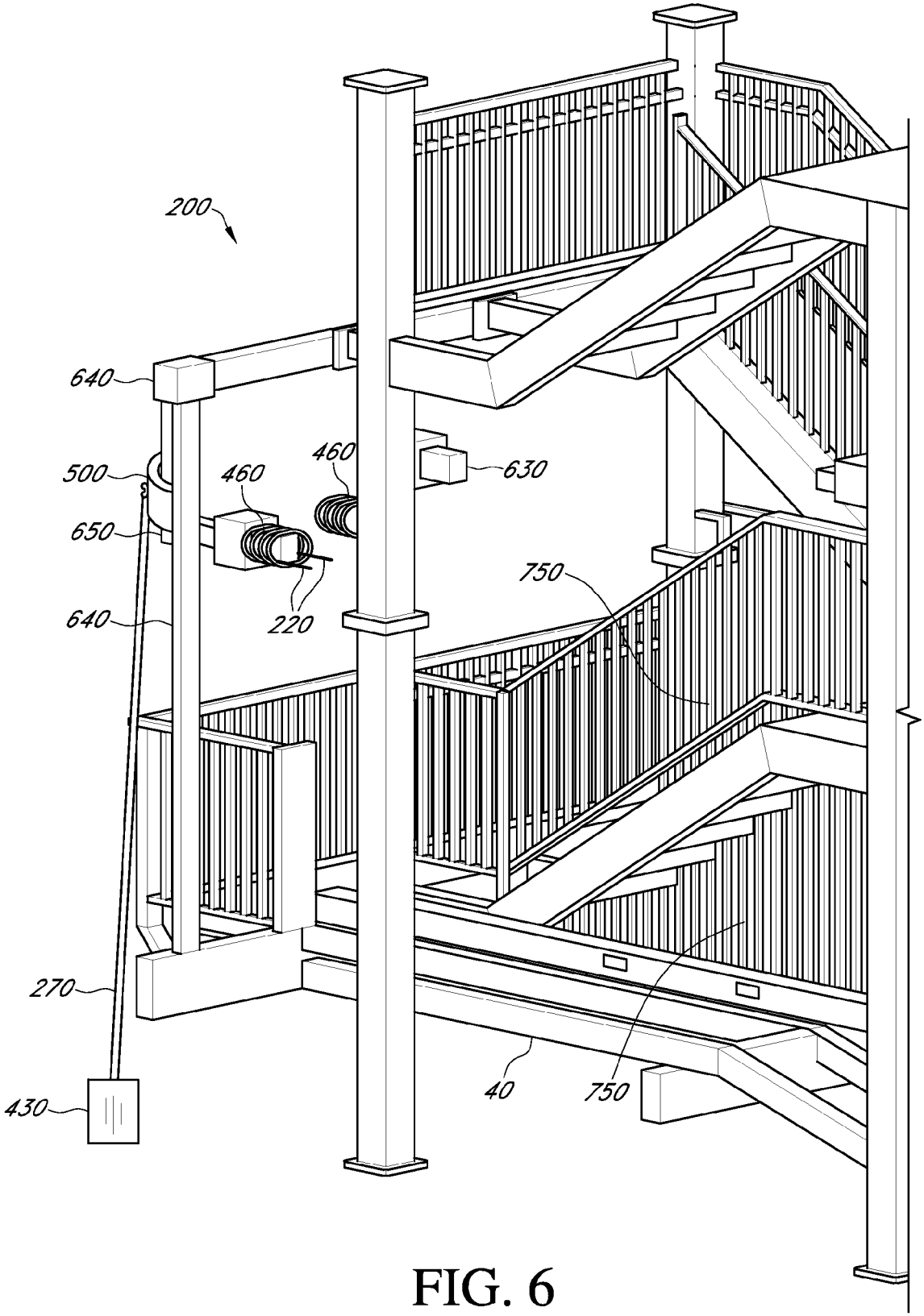
FIG. 6 is a pictorial of a portion of the stairwell 750 and tower 200 of an embodiment of the present invention.
Figure 7:
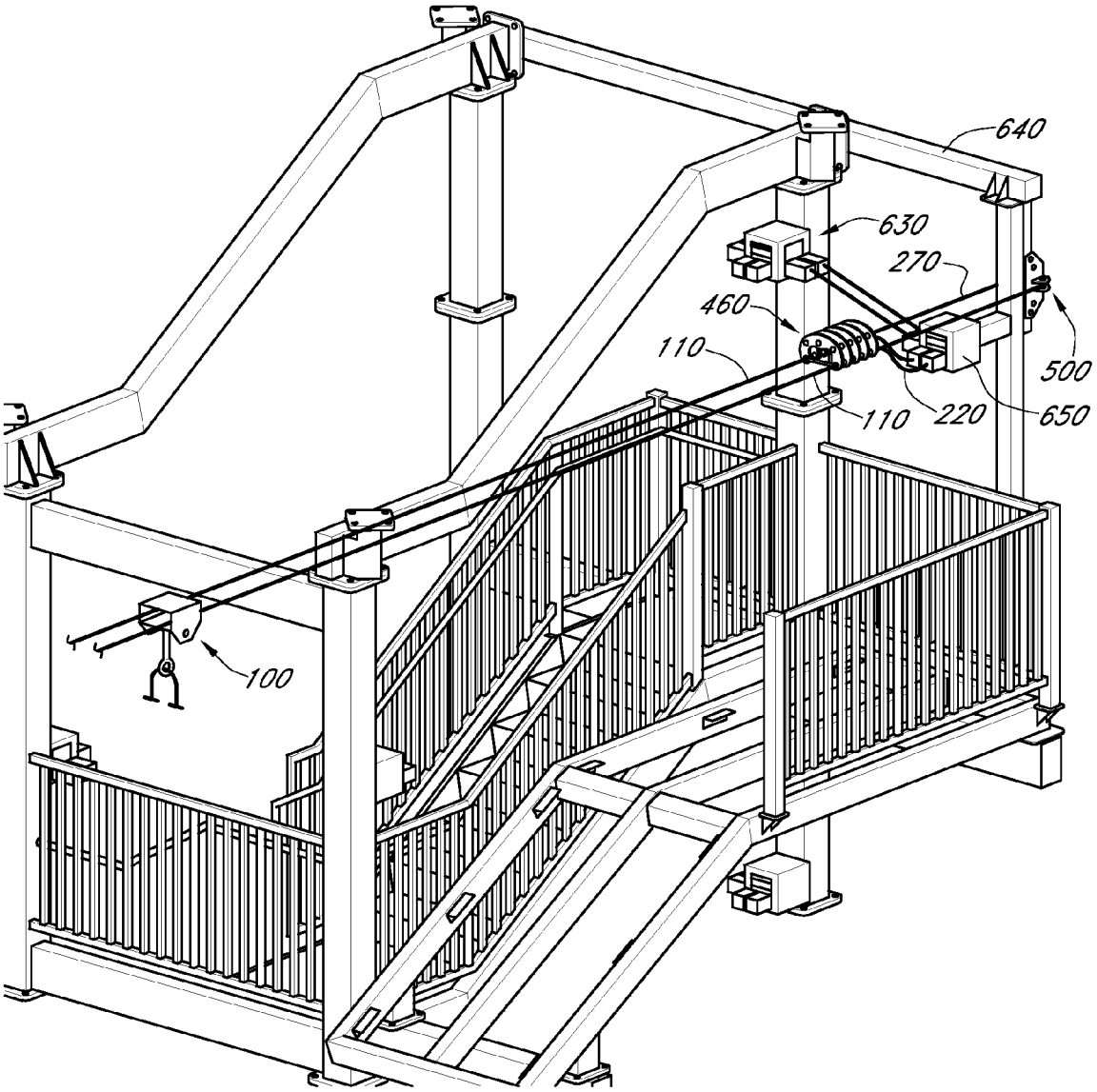
FIG. 7 is a pictorial of an embodiment of a portion of the tower and the inline transfer device 460.

FIG. 6 illustrates an embodiment of a tower 200 of the present invention 10. The tower 200 may have a stairwell 750 so people can ascend and descend to various destinations, such as the ground, to a landing ramp 40, or to a takeoff ramp 50. The tower 200 may have a termination post 640 that is oriented substantially vertical. The termination post 640 may have an adjustable height termination assembly 500 adjustably mounted thereon. The adjustable height termination assembly 500 may receive a device to counterweight cable 270. The zip line cables 220 may extend through the adjustable height termination assembly 500 to a counterweight 430, as illustrated in FIG. 7 So at one end, the zip line cables 220 may be connected to the counterweight 430, and at the other end to a termination post 640. In another embodiment, one end of the zip line cables 220 may be connected to a counterweight 430, and the other end also to a counterweight 430.

Figure 10:
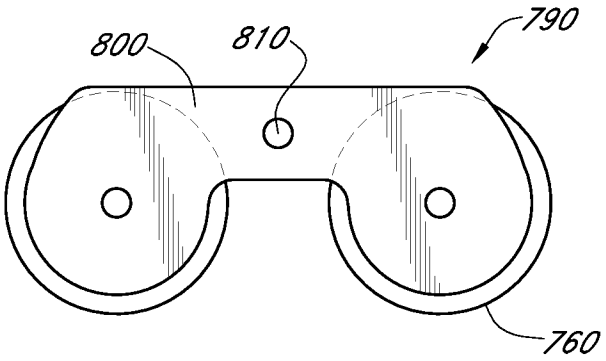
FIG. 10 is a pictorial of an embodiment of a trolley wheel carriage 790 of the present invention.

As illustrated in FIGS. 8 and 9, the moveable member 100 or trolley 100 may have a head 700 having a cable receiving aperture 710 therein. In one embodiment, there may be more than one cable receiving aperture 710. A neck 740 may extend from said head 700. The neck 740 may have a safety cable attachment 720 to allow a user to attach a safety cable (not illustrated) to the neck 740. In one embodiment the cable receiving aperture 710 has a rotatable pulley (not illustrated) secured therein, which can rotate to allow the moveable member 100 to move relative to a cable, such as a device to device cable 110, or a non tensioned cable 220. In one embodiment, as illustrated in FIG. 10, the trolley 100 slides on the device to device cable 110. In another embodiment, as illustrated in FIG. 9, the trolley 100 has a trolley wheel carriage 790 pivotally disposed within a trolley upper portion 770. The trolley wheel carriage 790 may have four trolley wheels 760 rotatably disposed to the trolley wheel carriage 790. The four trolley wheels 760 may be aligned in two pairs, each pair may be displaced on one cable, so that there may be a "front" set of wheels, and a "rear" set of wheels, to keep the trolley 100 aligned, and reduce angular displacement 820 along a substantially vertical axis 830 as the trolley 100 is moving along a cable, such as the device to device cable 110, or any other cable.

FIG. 10 illustrates an embodiment of a trolley wheel carriage 790 of the present invention. The trolley wheel carriage 790 may be able to receive two pairs of rotatably disposed wheels 760. A trolley carriage pivot 810 may be pivotally attached to the trolley upper portion 770 to allow some pivoting about the axis (not illustrated) of the trolley carriage pivot 810. This may allow the trolley carriage pivot 810 to pivot according to the positioning of any cable that the wheels 760 may be on. In addition, in one embodiment each trolley wheel carriage 790 may be pivotally disposed to said trolley upper portion 770, but independent of the other trolley wheel carriage 790, to allow for independent suspension of each pair of wheels 760.

In one embodiment, two trolley wheel carriages 790 may be secured to the trolley 100. The trolley wheel carriage 790 may have two trolley wheels 760 rotationally disposed in-line thereon. "In-line" is defined as being able to roll along the same device to device cable 110. The two in-line wheels may be oriented in a manner similar to a front left and rear left wheel of a 4-wheeled motor vehicle. This may allow the trolley 100 to be displaced on two adjacent device to device cables 110.

In one embodiment a separator 840 may be disposed between the trolley lower portion 780 and a neck 740. This way the neck 740 acts as a handle, and the separator 840 prevents the user from holding the trolley 100 above the separator 840. The neck 740 may extend downwardly from the trolley lower portion 780 to terminate in a safety cable attachment 720. The safety cable attachment 720 may be have an attachment aperture 725 so that a cable may be tied to it, or may go through the attachment aperture 725 and tied to another part of the cable.

It should be understood, of course, that the foregoing relates to exemplary embodiments of the invention and that modifications may be made without departing from the spirit and scope of the invention as set forth in the following claims.

I claim:

1. A zip line transfer device (10), comprising:

a device to device cable (110) extending from a first tower to a second tower;

a trolley (100) having a trolley wheel carriage (790) secured to said trolley (100);

a non tensioned cable (220) connected to an inline transfer device (460), said non tensioned cable (220) extending from said inline transfer device (460) to at least one of either a landing ramp exit device (650) or a safety cable transfer device (630), said landing ramp exit device (650) and said safety cable transfer device (630) secured to said tower (200).

2. A zip line transfer device (10), comprising:

a tower (200);

a device to counterweight cable (270) extending from a counterweight (430) to an inline transfer device (460);

a device to device cable (110) connected at one end to said inline transfer device (460), and at another end to at least one of either another tower (200) or another inline transfer device (460);

an adjustable height termination means (500) movably disposed on said tower (200), said device to counterweight cable (270) extending from a counterweight (430) to said inline transfer device (460) via said adjustable height termination means (500);

a trolley (100) that is capable of being displaced on said device to device cable (110);

a non tensioned cable (220) connected to said inline transfer device (460), said non tensioned cable (220) extending from said inline transfer device (460) to at least one of either a landing ramp exit device (650) or a safety cable transfer device (630), said landing ramp exit device (650) and said safety cable transfer device (630) secured to said tower (200); an ascending-descending means (750), whereby a person may be able to ascend or descend the tower (200) so that the person may removably be connected to said (100) at ground level before ascension, and the person may then traverse said device to device cable (110) and said non tensioned cable (220); and at least one of either said cable to cable (110), said non tensioned cable (220) and said device to counterweight cable (270) is a dual cable.

* * * * *